US008157618B2

(12) United States Patent
Shibata

(10) Patent No.: US 8,157,618 B2
(45) Date of Patent: Apr. 17, 2012

(54) EYEGLASS LENS PROCESSING APPARATUS

(75) Inventor: Ryoji Shibata, Toyokawa (JP)

(73) Assignee: Nidek Co., Ltd., Aichi (JP)

( * ) Notice: Subject to any disclaimer, the term of this patent is extended or adjusted under 35 U.S.C. 154(b) by 617 days.

(21) Appl. No.: 12/344,710

(22) Filed: Dec. 29, 2008

(65) Prior Publication Data

US 2009/0170403 A1 Jul. 2, 2009

(30) Foreign Application Priority Data

Dec. 29, 2007 (JP) ..... 2007-341524

(51) Int. Cl.

| | |
|---|---|
| ***B24B 1/00*** | (2006.01) |
| ***B24B 7/19*** | (2006.01) |
| ***B24B 7/30*** | (2006.01) |
| ***B26D 7/06*** | (2006.01) |
| ***B26D 5/08*** | (2006.01) |
| ***B26D 3/02*** | (2006.01) |
| ***G06F 19/00*** | (2006.01) |

(52) U.S. Cl. ..... 451/43; 451/5; 83/432; 83/581; 83/869; 700/157

(58) Field of Classification Search ..... 700/95, 700/117, 157; 702/155, 167; 451/1, 5, 41–44; 83/425, 432, 523, 581, 869

See application file for complete search history.

(56) References Cited

U.S. PATENT DOCUMENTS

| | | | | |
|---|---|---|---|---|
| 5,333,412 | A | 8/1994 | Matsuyama | |
| 5,782,590 | A * | 7/1998 | Morrison | 409/124 |
| 6,062,947 | A * | 5/2000 | Obayashi et al. | 451/5 |
| 6,095,896 | A | 8/2000 | Kobayashi | |
| 6,099,383 | A * | 8/2000 | Mizuno et al. | 451/5 |
| 7,125,314 | B2 * | 10/2006 | Shibata | 451/5 |
| 7,295,886 | B2 * | 11/2007 | Shibata | 700/157 |
| 7,448,938 | B2 * | 11/2008 | Inoguchi | 451/5 |
| 7,661,819 | B2 * | 2/2010 | Mazoyer | 351/178 |
| 7,840,294 | B2 * | 11/2010 | Takeichi | 700/97 |
| 7,980,920 | B2 * | 7/2011 | Akiyama et al. | 451/5 |
| 2007/0298686 | A1 | 12/2007 | Shibata | |
| 2009/0268199 | A1 * | 10/2009 | Inoguchi | 356/124 |

FOREIGN PATENT DOCUMENTS

| | | | |
|---|---|---|---|
| EP | 0666139 | A1 | 8/1995 |
| EP | 1642678 | A1 | 4/2006 |

(Continued)

OTHER PUBLICATIONS

Extended European Search Report dated Apr. 23, 2009.

*Primary Examiner* — Crystal J Barnes-Bullock
(74) *Attorney, Agent, or Firm* — Sughrue Mion, PLLC

(57) ABSTRACT

An eyeglass lens processing apparatus includes: a setting unit which sets points on an edge of a lens, where a line on a target lens shape and passing through the first and second points intersects a line on the target lens shape and passing through the third and fourth points; and a calculating unit which: obtains a first plane including a bisection point between the first and second points and perpendicular to the first line; obtains a second plane including a bisection point between the third and fourth points and perpendicular to the second line; obtains an intersection line of the first and second planes; obtains a bevel spherical surface so that a center of the bevel spherical surface is located on the intersection line and passes through a desired edge position; and obtains the bevel path on the basis of the bevel spherical surface and target lens shape data.

10 Claims, 7 Drawing Sheets

FOREIGN PATENT DOCUMENTS

| | | | | |
|---|---|---|---|---|
| EP | 1974856 | A1 | | 10/2008 |
| EP | 2031435 | A1 | | 3/2009 |
| JP | 4-93164 | A | | 3/1992 |
| JP | 11-70451 | A | | 3/1999 |
| JP | 2006-142473 | A | | 6/2006 |
| JP | 2009160682 | A | * | 7/2009 |

* cited by examiner

EYEGLASS LENS PROCESSING APPARATUS

BACKGROUND OF THE INVENTION

The present invention relates to an eyeglass lens processing apparatus for processing a peripheral edge of an eyeglass lens.

As a method of forming a bevel used to support an eyeglass lens using a groove of a rim of an eyeglass frame, there are known a method based on a lens front surface curve (front curve based), a method based on a lens rear surface curve (rear curve based), and a method of dividing an edge thickness by a predetermined ratio. Generally, the method corresponding to a lens shape is used. When a frame curve is largely different from the bevel curve set by means of those methods, the lens having the bevel formed thereon cannot be inserted into the rim in some cases. As a method of coping with this problem, there are proposed various methods of tilting the bevel curve in accordance with the frame curve (Japanese Patent Application Laid-Open No. H11-70451 (U.S. Pat. No. 6,095,896) and Japanese Patent Application Laid open No. 2006-142473).

However, in the known method of tilting the bevel curve, it is necessary for an operator to consider a tilt amount and a tilt direction of the bevel curve in order to dispose the bevel having a good appearance, and it is difficult for an operator who is not accustomed to a processing operation to set the appropriate bevel. Additionally, in the method of determining the bevel curve in accordance with the frame curve at the first time and tilting the bevel curve, the bevel curve cannot be disposed within the edge thickness of the lens in some cases. In this case, the operator needs to check the bevel curve value again whenever the tilt amount and the tilt direction of the bevel curve are changed. As a result, it takes trouble to form the bevel having a good appearance.

SUMMARY OF THE INVENTION

The present invention is contrived in consideration of the above-described problems, and an object of the invention is to provide an eyeglass lens processing apparatus capable of appropriately setting a bevel curve in accordance with a frame curve or a desired bevel curve without any trouble and of appropriately setting a bevel having a good appearance even when a bevel curve value is changed.

In order to solve the problem, the present invention provides the following arrangements.

(1) An eyeglass lens processing apparatus for processing a bevel in a peripheral edge of an eyeglass lens, the apparatus comprising:

a data input unit which obtains a shape data of a rim of an eyeglass frame;

an edge position detecting unit which obtains edge positions of front and rear surfaces of the lens on the basis of target lens shape data obtained from the rim shape data;

a bevel curve setting unit which sets a bevel curve formed on the lens edge and includes an input unit used to select the bevel curve substantially equal to a frame curve based on at least the rim shape data;

a reference point setting unit which sets first, second third and fourth points which are located on the lens edge and are used as a reference to obtain a bevel path, so that a line located on the target lens shape and passing through the first and second points intersects a line located on the target lens shape and passing through the third and fourth points; and a bevel path calculating unit which:

a) obtains a first plane including a bisection point of a first line connecting the first and second points and perpendicular to the first line;

b) obtains a second plane including a bisection point of a second line connecting the third and fourth points and perpendicular to the second line;

c) obtains an intersection line at which the first and second planes intersect each other;

d) obtains a bevel spherical surface so that a center of the bevel spherical surface having a radius of the bevel curve set by the bevel curve setting unit is located on the intersection line and the bevel spherical surface passes through a desired edge position; and e) obtains the bevel path on the basis of the target lens shape data and the obtained bevel spherical surface.

(2) The eyeglass lens processing apparatus according to (1), wherein the reference point setting unit sets the points by a predetermined method on the basis of the target lens shape data and a detection result of the edge position detecting unit.

(3) The eyeglass lens processing apparatus according to (2), wherein the reference point setting unit includes a display which displays the target lens shape and designates the positions of the points in the target lens shape on the display in advance.

(4) The eyeglass lens processing apparatus according to (2), wherein the reference point setting unit sets the points so that the line located on the target lens shape and passing through the first and second points is substantially perpendicular to the line located on the target lens shape and passing through the third and fourth points.

(5) The eyeglass lens processing apparatus according to (2), wherein the reference point setting unit sets the points so that the line located on the target lens shape and passing through the first and second points and the line located on the target lens shape and passing through the third and fourth points pass through a geometric center of the target lens shape.

(6) The eyeglass lens processing apparatus according to (2), wherein the reference point setting unit sets the positions of the points located on the lens edge to any one of a position which is offset from the front surface of the lens by a predetermined distance, a position at which an edge thickness of the lens is divided by a predetermined ratio, and a position which is further offset by the predetermined distance from the position obtained by dividing the edge thickness by the predetermined ratio.

(7) The eyeglass lens processing apparatus according to (1), wherein the reference point setting unit includes a display which displays a assist screen in which a lens shape is displayed on the basis of a detection result of the target lens shape data and the edge position detecting units and which allows an operator to set the four points.

(8) The eyeglass lens processing apparatus according to (1), wherein the bevel path calculating unit includes a selection unit used to select the bevel spherical surface passing through the first and second points or the bevel spherical surface passing through the third and fourth points upon obtaining the bevel spherical surface.

(9) The eyeglass lens processing apparatus according to (1), wherein the bevel path calculating unit selects the bevel spherical surface passing through the first and second points or the bevel spherical surface passing through the third and fourth points on the basis of a detection result of the edge position detecting units upon obtaining the bevel spherical surface.

(10) The eyeglass lens processing apparatus according to (1), wherein when the obtained bevel path is not within an edge thickness of the lens, the bevel path calculating unit changes the bevel curve to be approximate to the frame curve, and obtains a corrected bevel path in which a center of the bevel spherical surface having a radius of the changed bevel curve is located on the intersection line and which is within the edge thickness on the basis of the target lens shape data and the bevel spherical surface.

DESCRIPTION OF PREFERRED EMBODIMENTS

Figure 1:
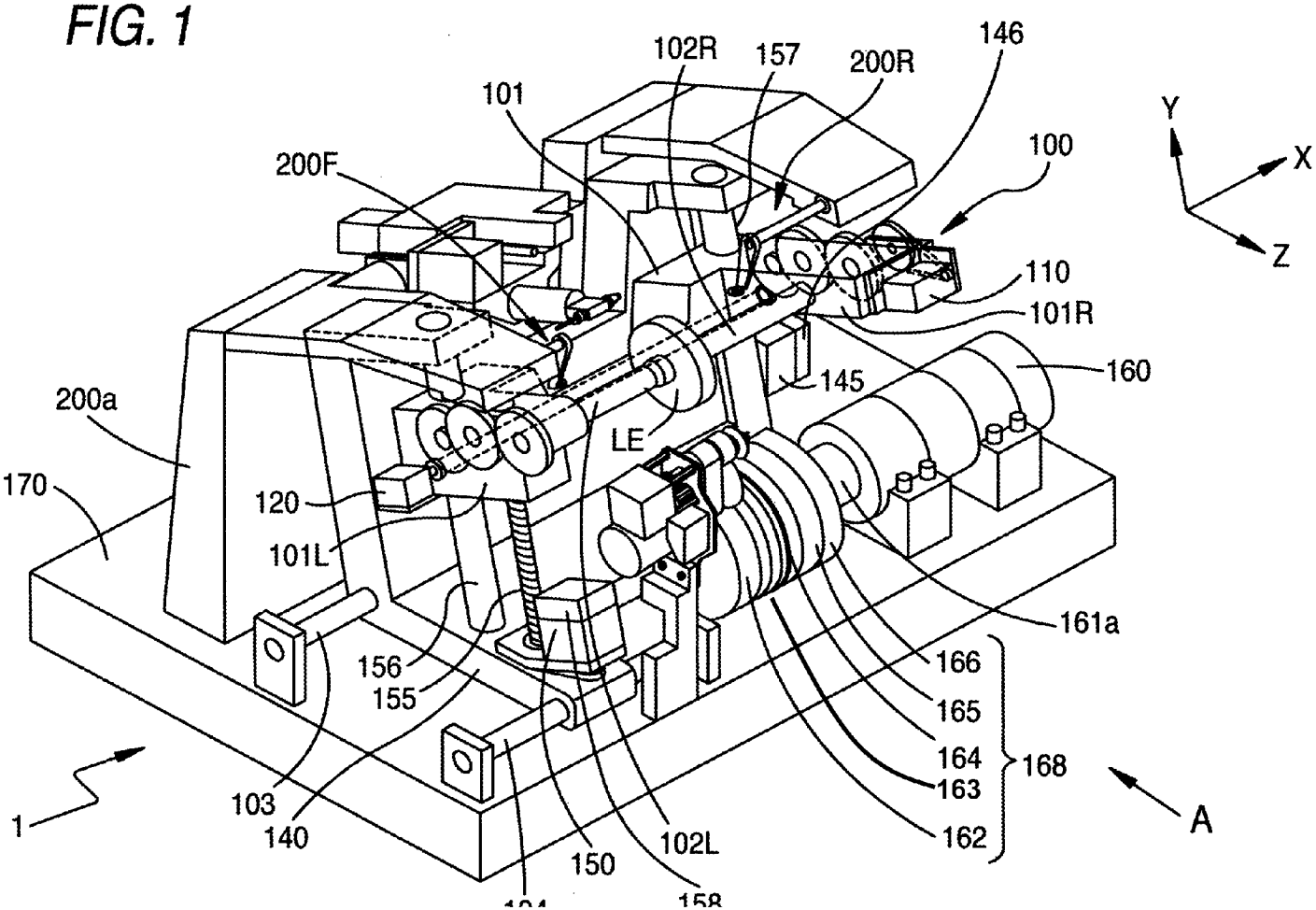
FIG. 1 is a schematic configuration diagram showing a processing mechanism part of an eyeglass lens processing apparatus.

Hereinafter, an embodiment of the invention will be described with reference to the accompanying drawings. FIG. 1 is a schematic configuration diagram showing a processing mechanism part of an eyeglass lens processing apparatus according to the invention.

A carriage unit 100 is mounted onto a base 170 of a processing apparatus body 1. Then, a peripheral edge of a processed lens LE interposed between lens chuck shafts (lens rotary shafts) 102L and 102R included in a carriage 101 is processed by a grindstone group 168 coaxially attached to a grindstone spindle 161*a* in a press-contact state. The grindstone group 168 includes a glass roughing grindstone 162, a high curve bevel-finishing grindstone 163 having a bevel inclined surface forming a bevel in a high curve lens, a finishing grindstone 164 having a V groove (bevel groove) VG forming a bevel in a low curve lens and a plane processing surface, a flat-polishing grindstone 165, and a plastic roughing grindstone 166. The grindstone spindle 161*a* is rotated by a motor 160.

The lens chuck shaft 102L and the lens chuck shaft 102R are coaxially supported to a left arm 101L and a right arm 101R of the carriage 101, respectively, so as to be rotatable. The lens chuck shaft 102R is moved to the lens chuck shaft 102L by a motor 110 attached to the right arm 101R. Then, the lens LE is held by the two lens chuck shafts 102R and 102L. Additionally, the two lens chuck shafts 102R and 102L are rotated in a synchronized manner by a motor 120, attached to the left arm 101L, via a rotary transmission mechanism such as a gear. Accordingly, a lens rotary mechanism is configured in this manner.

The carriage 101 is mounted on a moving support base 140 capable of moving in an X-axis direction along shafts 103 and 104 extending in parallel to the lens chuck shafts 102R, 102L and the grindstone spindle 161*a*. A ball screw (not shown) extending in parallel to the shaft 103 is attached to the rear portion of the support base 140, and the ball screw is attached to a rotary shaft of an X-axis-direction movement motor 145. In terms of a rotation of the motor 145, the carriage 101 is linearly moved in an X-axis direction (an axial direction of the lens chuck shaft) together with the support base 140. Accordingly, an X-axis-direction movement unit is configured in this manner. A rotary shaft of the motor 145 is provided with an encoder 146 as a detector for detecting a movement of the carriage 101 in an X-axis direction.

Additionally, shafts 156 and 157 extending in a Y-axis direction (a direction in which a distance between the shaft of the lens chuck shafts 102R, 102L and the shaft of the grindstone spindle 161*a* changes) are fixed onto the support base 140. The carriage 101 is mounted on the support base 140 so as to be movable in a Y-axis direction along the shafts 156 and 157. A Y-axis-direction movement motor 150 is fixed onto the support base 140. A rotation of the motor 150 is transmitted to a ball screw 155 extending in a Y-axis direction, and the carriage 101 is moved in a Y-axis direction by a rotation of the ball screw 155. Accordingly, a Y-axis-direction movement unit is configured in this manner. A rotary shaft of the motor 150 is provided with an encoder 158 as a detector for detecting a movement of the carriage 101 in a Y-axis direction.

Figure 2:
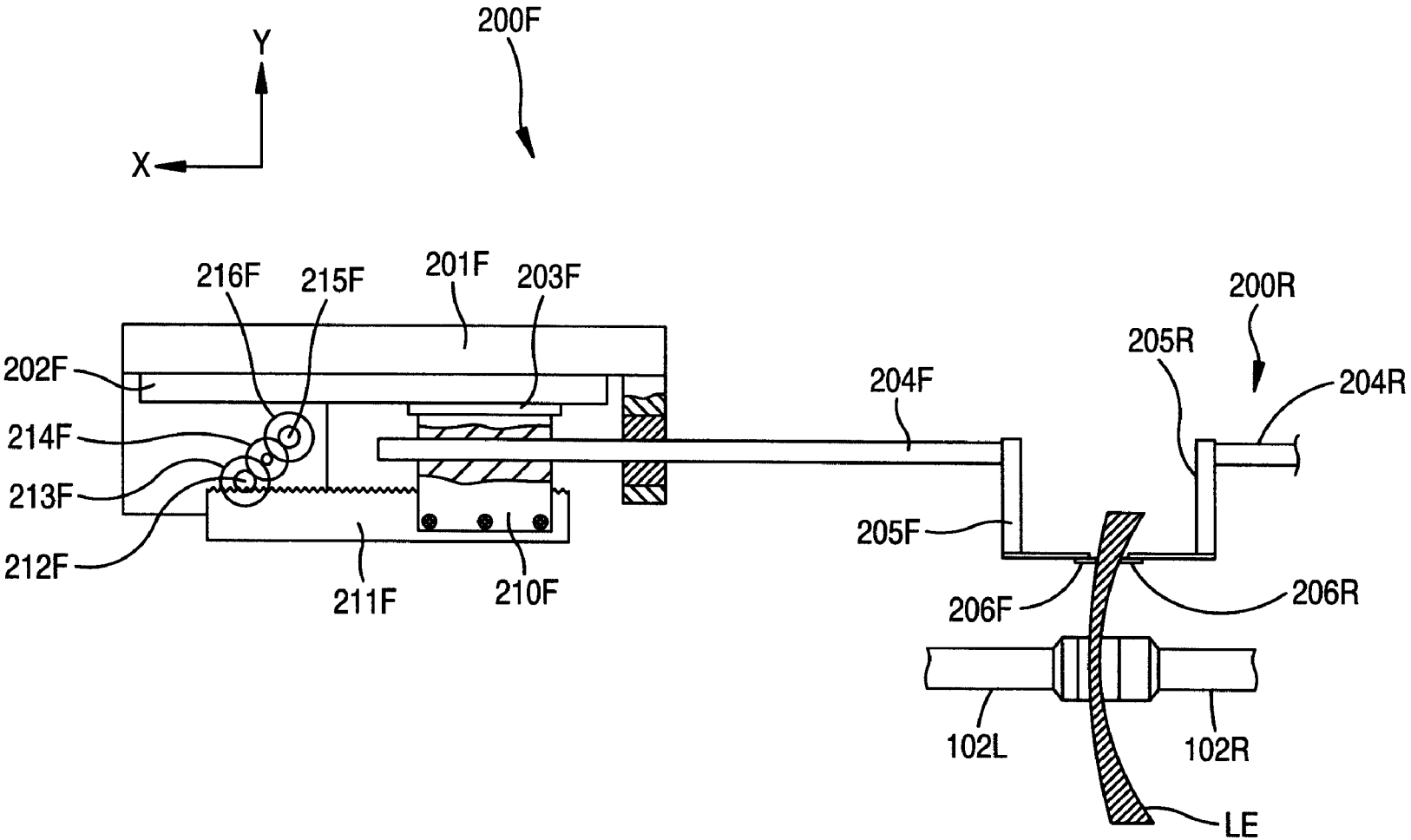
FIG. 2 is a schematic configuration diagram showing a lens edge position measurement unit.

In FIG. 1, lens edge position measurement units (lens edge position detecting units) 200F and 200R are provided above the carriage 101. FIG. 2 is a schematic diagram showing the measurement unit 200F for measuring a lens edge position of a front surface of the lens. An attachment support base 201F is fixed onto a support base block 200*a* fixed onto a base 170 shown in FIG. 1, and a slider 203F is slidably attached to a rail 202F fixed to the attachment support base 201F. A slide base 210F is fixed to the slider 203F, and a measurement portion arm 204F is fixed to the slide base 210F. An L-shape hand 205F is fixed to a front end portion of the measurement portion arm 204F, and a measurement portion 206F is fixed to a front end portion of the hand 205F. The measurement portion 206F makes contact with a front-side refractive surface of the lens LE.

A rack 211F is fixed to a lower end portion of the slide base 210F. The rack 211F meshes with a pinion 212F of an encoder 213F fixed to the attachment support base 201F. Additionally, a rotation of a motor 216F is transmitted to the rack 211F via a gear 215F, an idle gear 214F, and the pinion 212F, thereby moving the slide base 210F in an X-axis direction. During the measurement of the lens edge position, the motor 216F presses the measurement portion 206F against the lens LE at the fixed force all the time. The pressing force of the measurement portion 206F applied from the motor 216F to the lens refractive surface is set to a small force in order to prevent a scratch of the lens refractive surface. As means for applying a pressing force of the measurement portion 206F against the lens refractive surface, pressure applying means such as a known spring may be employed. The encoder 213F detects the movement position of the measurement portion 206F in an X-axis direction by detecting the movement position of the slide base 210F. On the basis of the movement position information, the rotary angle information of the lens chuck shafts 102L, 102R, and the Y-axis-direction movement information, the edge position of the front surface of the lens LE (including the lens front-surface position) is measured.

Since a configuration of the measurement unit 200R for measuring the edge position of a rear surface of the lens LE is symmetric to the configuration of the measurement unit 200F, "F" of the reference numerals given to the components of the measurement unit 200F shown in FIG. 2 is exchanged with "R", and the description thereof will be omitted.

During the measurement of the lens edge position, the measurement portion 206F comes into contact with the front surface of the lens, and the measurement portion 206R comes into contact with the rear surface of the lens. When the carriage 101 is moved in a Y-axis direction and the lens LE is rotated on the basis of a target lens data in this state, the edge positions of the front surface and the rear surface of the lens are simultaneously measured for processing a peripheral edge of the lens.

Further, the X-axis-direction movement unit and the Y-axis-direction movement unit of the eyeglass lens processing apparatus shown in FIG. 1 may be configured such that the grindstone spindle 161*a* is relatively moved in an X-axis direction and a Y-axis direction with respect to the lens chuck shaft (102L and 102R). Furthermore, the lens edge position measurement units 200F and 200R may be configured such that the measurement portions 206F and 206R are moved in a Y-axis direction with respect to the lens chuck shaft (102L and 102R).

Figure 3:
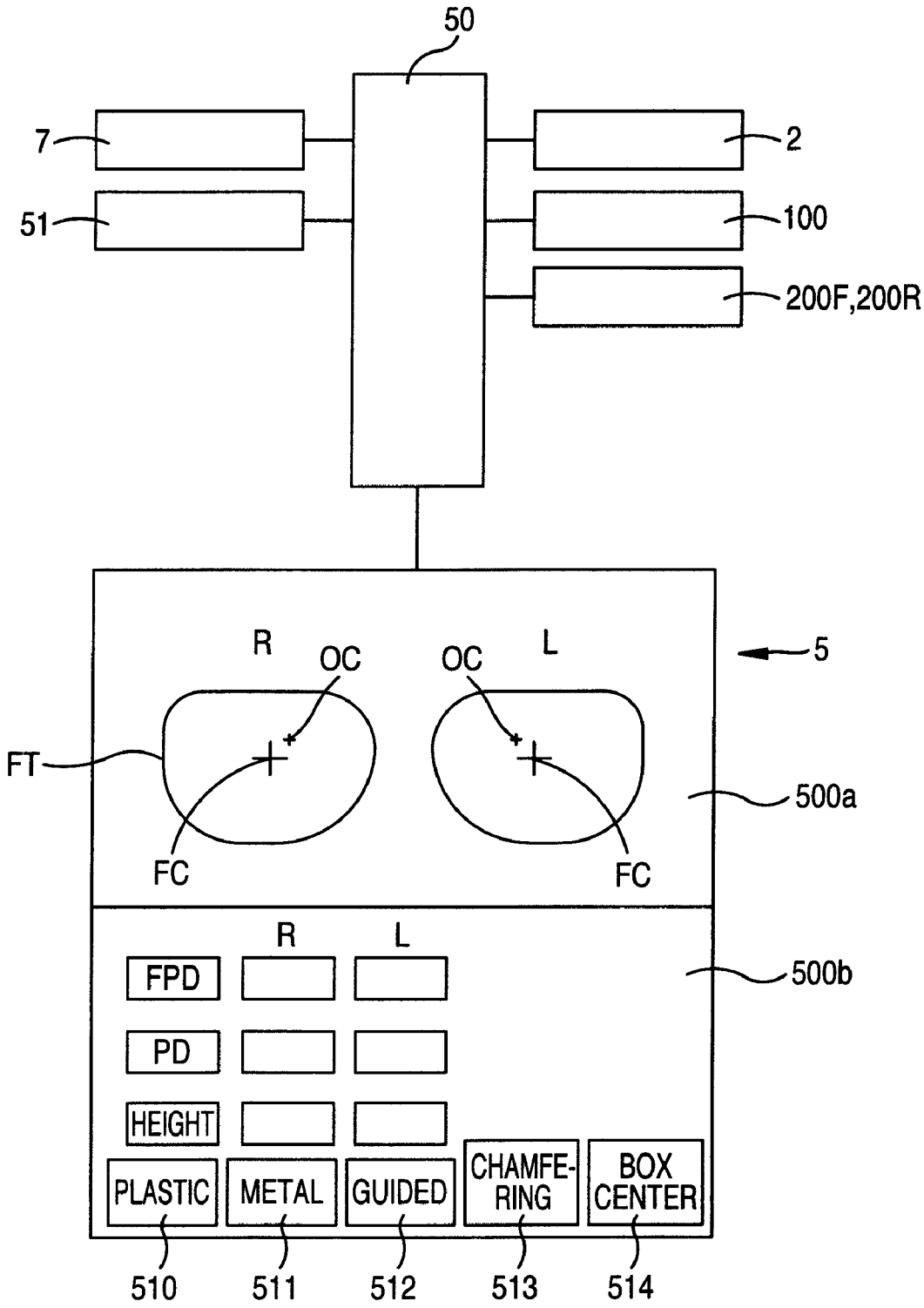
FIG. 3 is a control block diagram showing the eyeglass lens processing apparatus.

FIG. 3 is a control block diagram showing the eyeglass lens processing apparatus. A control unit 50 is connected to an eyeglass frame shape measurement unit 2 (such as the unit disclosed in Japanese Patent Application Laid-Open No. H04-93164 (U.S. Pat. No. 5,333,412)), a switch unit 7, a memory 51, the carriage unit 100, the lens edge position measurement units 200F, 200R, a display 5 as input means and display means of a touch-panel type, and the like. The control unit 50 receives an input signal by means of a touch panel function of the display 5, and controls a display of information and a figure of the display 5.

An operation of the apparatus having the above-described configuration will be described. When the switch included in the switch unit 7 is pressed, a target lens shape data and a frame curve obtained on the basis of a rim (lens frame) of the eyeglass frame F are input from the eyeglass frame shape measurement unit 2 and are stored in the memory 51. The target lens shape data is given by a radial length and a radial angle.

The frame curve is obtained from a three-dimensional rim shape data (frn, fθn, and fZn) (n=1, 2, 3, . . . , N) obtained by the eyeglass frame shape measurement unit 2. The fZn is a data in a height direction of a target lens shape. The frame curve is a curve obtained when the three-dimensional rim shape data (frn, fθn, and fZn) (n=1, 2, 3, . . . , N) is approximated to one spherical curve. The frame curve is obtained in such a manner that a sphere having a spherical surface provided with four certain points is obtained and a radius thereof is obtained. However, it is desirable that a plurality of spherical curves is obtained by changing a data in use and an average thereof is obtained. The eyeglass frame shape measurement unit 2 calculates the frame curve on the basis of the three-dimensional shape data, but the control unit 50 may carry out the calculation by inputting the three-dimensional shape data to the apparatus.

When the target lens shape data or the like is input, a target lens shape figure FT based on the input target lens shape data is displayed on a screen 500*a* of the display 5. Then, it becomes a state capable of inputting layout data (a data of a positional relationship of an optical center of the lens LE with respect to the geometrical center of the target lens shape) such as a wearer's pupillary distance (PD value), a frame pupillary distance (FPD value) of the eyeglass frame F, and a height of an optical center of the lens LE with respect to the geometrical center of the target lens shape. The layout data is input by operating a predetermined touch key displayed on a screen 500*b*. Additionally, a processing condition such as a lens material, a frame type, a processing mode, and a chamfering is selected by means of touch keys 510, 511, 512, and 513. In the processing mode using the touch key 512, an automatic beveling mode and a guided beveling mode can be selected.

Additionally, before the lens LE is processed, an operator fixes a cup as a jig onto the front surface of the lens LE by means of a blocker. At this time, there are an optical center mode for fixing the cup at the optical center OC of the lens LE and a boxing center mode for fixing the cup at the geometrical center FC of the target lens shape. The optical center mode or the boxing center mode is selected by the touch key 514. In a case where the boxing center mode is selected, the geometrical center FC of the target lens shape is held by the lens chuck shafts 102R and 102L, and the geometrical center FC corresponds to a rotary center (a processing center of the lens LE) of the lens LE. Additionally, in a case where the optical center mode is selected, the optical center of the lens LE is held by the lens chuck shafts 102R and 102L, and the optical center of the lens LE corresponds to a rotary center (a processing center of the lens LE) of the lens LE. Then, the target lens shape radial data (frn and fθn) (n=1, 2, 3, . . . , N) input at the first time is changed to a new target lens shape radial data (rn and θn)(n=1, 2, 3, . . . , N) based on the optical center OC or the geometrical center FC corresponding to the rotary center of the lens LE.

When the data input necessary for the processing ends, the operator chucks the lens LE by means of the lens chuck shafts 102R and 102L, and operates the apparatus by pressing a start switch of the switch unit 7. The control unit 50 operates the lens edge position measurement units 200F and 200R in response to the start signal, and measures the edge positions of the front surface and the rear surface of the lens on the basis of the target lens shape data. The measurement positions of the front surface and the rear surface of the lens are, for example, a bevel top point position and an outside position distanced from the bevel top point position by a predetermined distance (0.5 mm). When the edge position information of the front surface and the rear surface of the lens is obtained, the bevel path is calculated by the control unit 50. In a case where the automatic beveling mode is selected by the touch key 512, the bevel top point is set throughout the whole circumference so that the edge thickness is divided by a predetermined ratio (for example, 3:7 in a direction from the front surface side of the lens). Subsequently, the Y-axis-direction movement of the lens chuck shafts 102R and 102L is controlled on the basis of the target lens shape data, and the circumference of the lens LE is processed by the roughing grindstone 166. Subsequently, the X-axis-direction movement and the Y-axis-direction movement of the lens chuck shafts 102R and 102L are controlled on the basis of the bevel path data, and the bevel is processed by the finishing grindstone 164.

Figure 4:
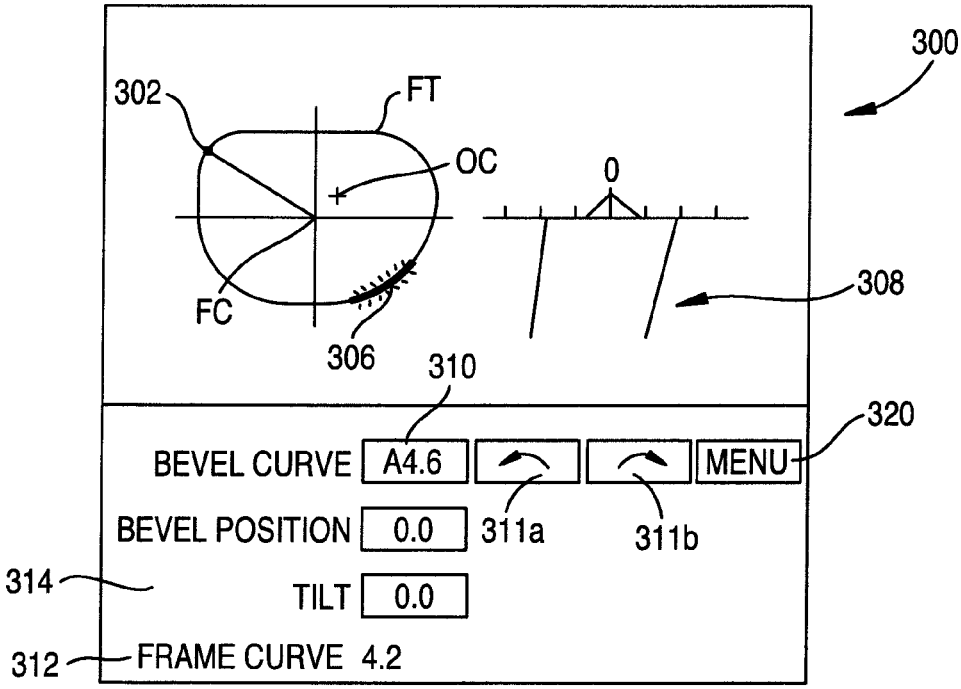
FIG. 4 is an explanatory diagram showing a bevel simulation screen.

A case will be described in which the guided beveling mode is selected. After the measurement of the edge positions of the front surface and the rear surface of the lens ends, as shown in FIG. 4, a bevel simulation screen 300 is displayed. In the bevel simulation screen 300, the bevel shape state is displayed in graphic. For example, in the screen 300, a bevel sectional shape 308 is displayed in graphic at a position where a cursor 302 is located at the target lens shape figure FT. In terms of a predetermined operation of a touch pen or keys 311*a* and 311*b*, the cursor 302 moves on the target lens shape figure FT on the basis of the geometrical center FC of the target lens shape figure FT. The bevel sectional shape 308 changes in accordance with the movement of the cursor 302.

An edit box 310 is provided below the screen 300 so as to arbitrarily set the bevel curve. First, in the same manner as the automatic beveling mode, the bevel path is calculated in which the bevel top point is located at a position where the edge thickness is divided by a predetermined ratio (here, 3:7), and the bevel path is set. Further, a display portion 312 below the screen displays a value of the frame curve (or the frame curve calculated by the control unit 50) input from the eyeglass frame shape measurement unit 2.

Here, when the frame curve is largely different from the bevel curve which is set in the same manner as the automatic beveling mode, the lens subjected to the beveling cannot be inserted into the rim or the bevel having a good appearance is not disposed at the edge in some cases. In this case, it is possible to input the bevel curve substantially equal to the frame curve by means of a ten key displayed upon touching the edit box 310 (that is, it is possible to select the bevel curve substantially equal to the frame curve). When the bevel curve value is changed, the edge-thickness dividing ratio is changed, and the bevel-top-point path approximate to the input curve value is calculated again. However, since a strength minus lens, a strength plus lens, an EX lens, and the like have a portion where the edge thickness is thick, in the bevel path in which the edge thickness throughout the whole circumference is divided by a predetermined ratio, an amount may increase in which the front surface or the rear surface of the lens protrudes from the time of the eyeglass frame, and the bevel path may not be appropriate for the external appearance. In order to cope with this situation, in the same manner as the technique disclosed in Japanese Patent Application Laid-Open No. H11-70451 (U.S. Pat. No. 6,095,896), a method may be used which tilts the bevel curve using a "tilt" setting box 314 (a tilt direction and a tilt amount of the bevel curve are adjusted) in a state where the bevel curve approximate to the frame curve is maintained. The degree of freedom is good for an operator who has knowledge about a bevel tilting operation. However, it is difficult for an operator who is not accustomed to the bevel tilting operation, and it takes trouble to set the bevel having a good appearance.

Therefore, in this apparatus, a mode in which the bevel curve substantially equal to the frame curve is automatically set without troublesomely using the "tilt" setting box 314 according to the related art is provided. Alternatively, there is provided a mode capable of arbitrarily changing the automatically set bevel curve. In the bevel simulation screen shown in FIG. 4, when a MENU key 320 is touched, a popup menu used for setting the bevel curve is displayed, and the modes of "a ratio", "a front curve based", "a rear curve based", and "a frame curve" are displayed in a selectable manner. Here, when "the frame curve" mode is selected, the bevel path of the bevel curve substantially equal to the frame curve or the bevel curve arbitrarily set by the operator is calculated by the control unit 50.

Figure 5:
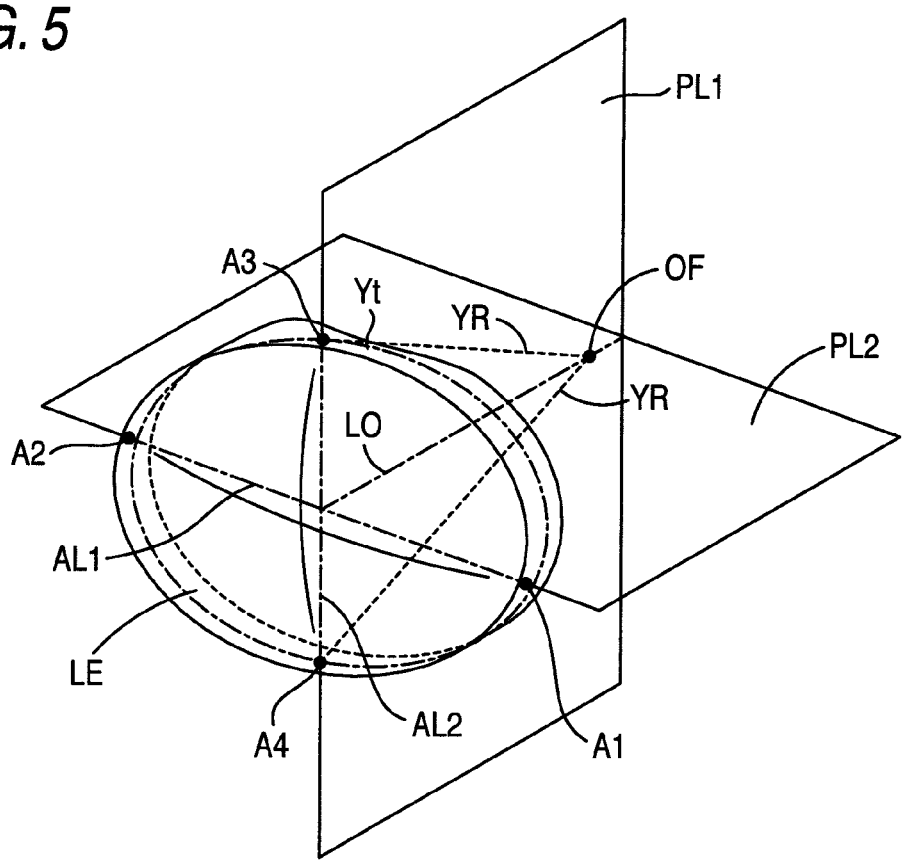
FIG. 5 is a perspective diagram showing a layout of the bevel at a lens edge position.
Figure 6:
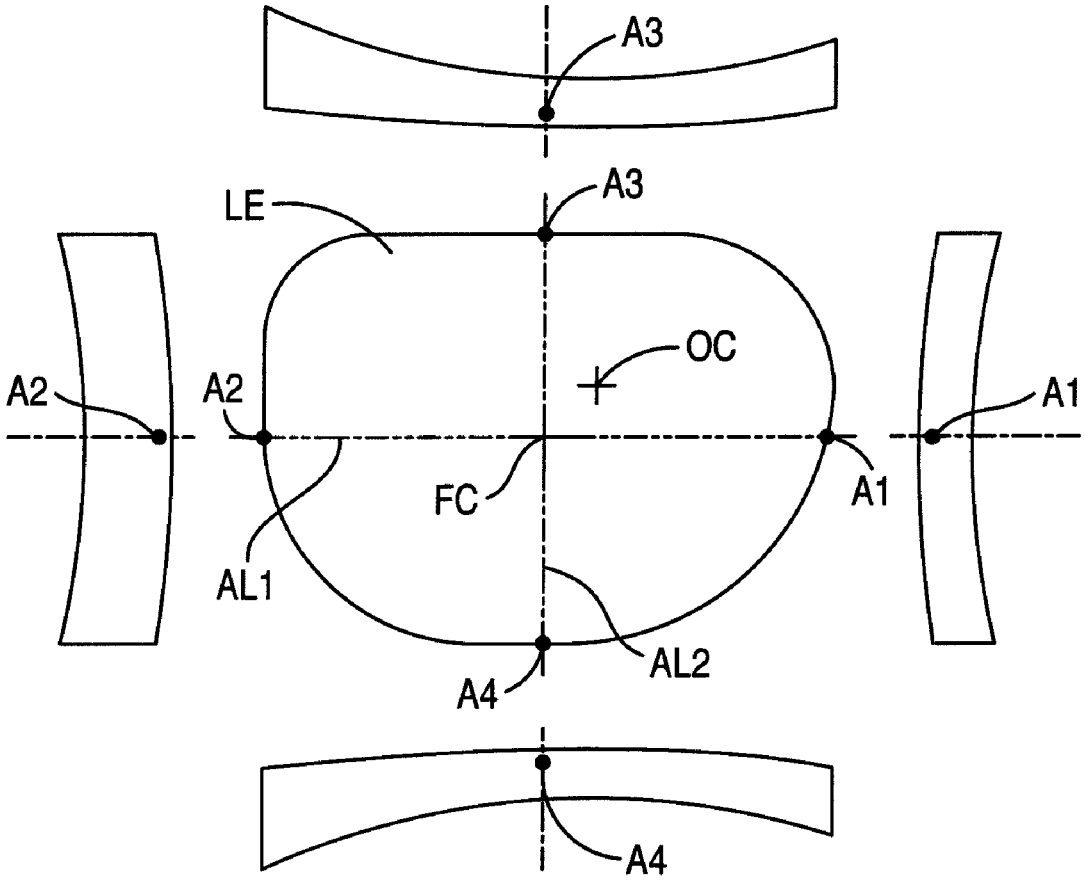
FIG. 6 is an explanatory diagram showing a case where the lens is viewed from the front side thereof and in horizontal and vertical directions.
Figure 8:
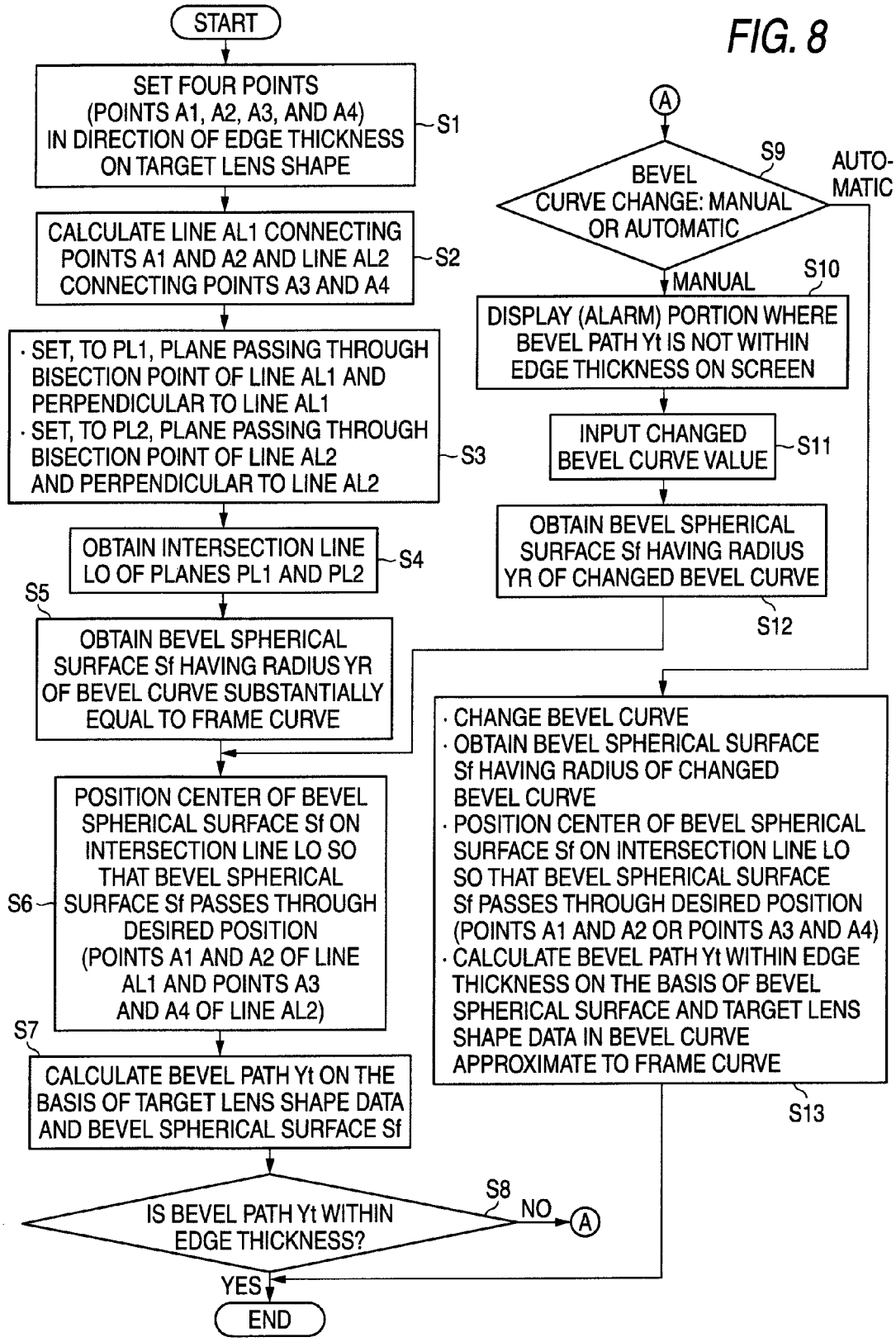
FIG. 8 is a flowchart showing a bevel path calculation.

The bevel path calculation upon selecting "the frame curve" mode will be described with reference to FIGS. 5, 6, and 8. FIG. 5 is a perspective view showing a layout of the bevel with respect to the edge of the lens LE. FIG. 6 is a top view showing the lens LE, where there is also provided a side view showing the lens LE in four directions, that is, in vertical and horizontal directions. FIG. 8 is a flowchart showing the bevel path calculation.

In contrast to a known method in which the tilt direction and the tilt amount of the bevel curve are set after calculating the bevel curve, in this mode it is assumed that the bevel path exists on a spherical surface, and an axis disposed at the center of the spherical surface (bevel spherical surface) is set at the first time. Then, the center of the spherical surface is made to move on the axis and the bevel path is determined within the edge thickness. Additionally, when this mode is selected, first, the bevel curve substantially equal to the frame curve is automatically selected by the control unit 50, and a value thereof is displayed on the edit box 310. In a case where the operator selects the bevel curve in this automatic setting mode, it is possible to change the bevel curve to a desired value by means of the ten key displayed upon touching the edit box 310 displayed on the simulation screen 300. Hereinafter, it will be described that the bevel curve substantially equal to the frame curve is set by the control unit 50.

First, as shown in FIGS. 5 and 6, four points being a first pair of two points A1 and A2 and a second pair of two points A3 and A4 are set by the control unit 50 at desired positions of the edge thickness of the lens LE and the target lens shape (Step S1). Since the four points are used to form the bevel having a good appearance on the circumference, the four points correspond to reference points through which the bevel top point passes. In most cases, the important positions used to obtain the bevel having a good appearance are positions on the side of an ear where the edge thickness is thick, a nose, an upper portion, and a lower portion. For this reason, for example, the pair of points A1 and A2 is set to be located on the target lens shape in a horizontal direction. Additionally, the pair of points A3 and A4 is set to be located on the target lens shape in a vertical direction (which corresponds to a vertical direction upon wearing the eyeglass frame). At this time, it is desirable that a line passing through the points A1 and A2 is substantially perpendicular to a line passing through the points A3 and A4. It is more desirable that the points A1 and A2 are located in a horizontal direction and the points A3 and A4 are located in a vertical direction with respect to the geometrical center FC of the target lens shape.

Additionally, the positions of the four points in a direction of the lens edge thickness are set by the following three methods. A first method is that the positions are set to be offset from the lens surface by a predetermined distance (for example, the four points are located at a position which is offset backward by 1 mm from the lens surface, or the point A1 on the side of the ear and the point A4 on the side of the lower portion are offset by 1.2 mm and the other points are offset by 1 mm). A second method is that the positions are set by dividing the lens edge thickness by a predetermined ratio (for example, the positions are set by dividing the edge thickness from the lens surface side by a ratio of 2:8). A third method is a combination of the first and second methods, where the positions are set to be offset by a predetermined distance from a position at which the edge thickness is divided by a predetermined ratio. Hereinafter, all the four points are set to the positions offset backward by 1 mm from the lens surface.

Further, the positions of the four points on the target lens shape and in a direction of the edge thickness are set by the control unit 50 so as to have the initial values as described above, and may be arbitrarily set by the operator's intension. For example, the display 5 is configured to display an assist screen of the figure (a figure of the target lens shape obtained when the lens LE is viewed from the front side and side figures thereof obtained when the lens LE is viewed in four directions, that is, in vertical and horizontal directions) shown in FIG. 6. The operator is capable of setting the desired four points by operating the input unit such as a touch pen. The top view of the lens LE shown in FIG. 6 is displayed on the basis of the target lens shape data. The side figures obtained when the lens LE is viewed in four directions, that is, in vertical and horizontal directions are displayed on the basis of the edge position measurement result of the front surface and the rear surface of the lens. However, as described below, the line (AL1) passing through a pair of two points (A1 and A2) and the line (AL2) passing through a pair of two points (A3 and A4) are set to have a nonparallel positional relationship (in other words, an intersecting positional relationship).

On the basis of the four points, the control unit 50 calculates the line AL1 (first line) connecting the points A1 and A2 and calculates the line AL2 (second line) connecting the points A3 and A4 (Step S2). Subsequently, a plane passing through a bisection point of the line AL1 and perpendicular to the line AL1 is set to PL1 (first plane). In the same manner, a plane passing through a bisection point of the line AL2 and perpendicular to the line AL2 is set to PL2 (second plane) (Step S3). Then, an intersection line LO at which the planes PL1 and PL2 intersect each other is obtained (Step S4). The intersection line LO corresponds to a reference axis used to position the center of the spherical surface having a radius of a bevel curve (hereinafter, a bevel spherical surface Sf).

Subsequently, the control unit 50 assumes that the bevel path exists on the bevel spherical surface Sf and obtains the bevel spherical surface Sf having a radius YR of the bevel curve substantially equal to the frame curve (Step 5). Additionally, the radius YR is obtained by a known method (in general, a value obtained by dividing "523" by the curve value) when the frame curve value is input from the eyeglass frame shape measurement unit 2. When the three-dimensional shape data (frn, fθn, and fZn) (n=1, 2, 3, . . . , N) measured by the eyeglass frame shape measurement unit 2 is input, as described above, the arbitrary four points are selected from the three-dimensional shape data as described above, and the radius YR is obtained by applying the four points to a spherical equation.

Subsequently, the control unit 50 allows a center OF of the bevel spherical surface Sf having the radius YR to be located on the intersection line LO so as pass through the desired edge position. For example, the center OF of the bevel spherical surface Sf is located on the intersection line LO so that the bevel spherical surface Sf passes through the two points (the pair of points A1 and A2) of the line AL1 or the two points (the pair of points A3 and A4) of the line AL2 (Step S6). In this case, one of the pairs of two points to be used is selected in advance or selected in accordance with the plus lens or the minus lens. For example, in a case of the minus lens, the pair of points A3 and A4 is selected in a vertical direction, and in a case of the plus lens, the pair of points A1 and A2 is selected in a horizontal direction. It is possible to determine whether the lens LE is the minus lens or the plus lens on the basis of the edge position measurement result of the front surface or the rear surface of the lens based on the target lens shape data. Alternatively, a configuration may be provided in which the operator selects the pair of two points to be used in accordance with the lens thickness or the target lens shape. In a case where the selection is carried out by the operator, a configuration is provided in which a selection screen is displayed by the MENU key 320. Additionally, it is possible to arbitrarily change the edge position through which the bevel spherical surface Sf passes. For example, as for the edge position, through which the bevel spherical surface set by the apparatus passes, the operator checks the bevel sectional shape 308 on the simulation screen, and changes the value of the bevel position setting box to move the edge position by a desired amount. Further, it is possible to allow the center OF of the bevel spherical surface Sf to be located on the intersection line LO so as to pass through a position distanced from the lens front surface or the center of the edge thickness by a predetermined distance at the position on the target lens shape having the thinnest edge thickness.

The control unit 50 calculates a bevel path Yt passing through the edge in the whole circumference of the lens on the basis of the target lens shape data and the bevel spherical surface Sf having the center OF located on the intersection line LO. That is, the bevel path Yt (rn, θn, and Zn)(n=1, 2, 3, . . . , N) in the whole circumference of the lens. LE is obtained by applying the target lens shape radial data (rn, θn) (n=1, 2, 3, . . . , N) at the processing center to the bevel spherical surface Sf having the radius YR (Step S7).

Figure 7A:
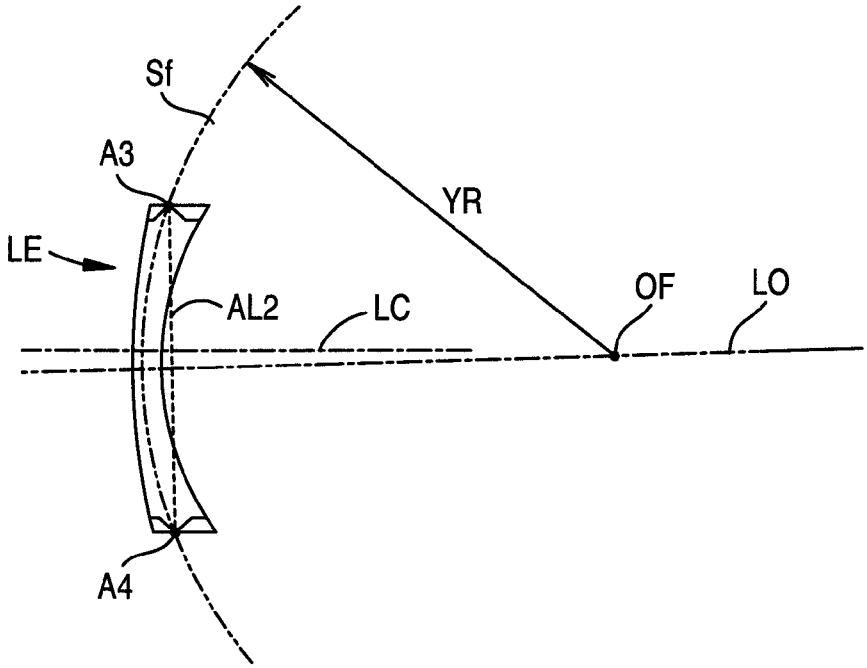
FIG. 7A is an explanatory diagram showing a case where a center of a bevel spherical surface is located on an intersection line so that the bevel spherical surface passes through two points set in a vertical direction, which is a cross sectional diagram showing the lens in a direction of a line AL2.
Figure 7B:
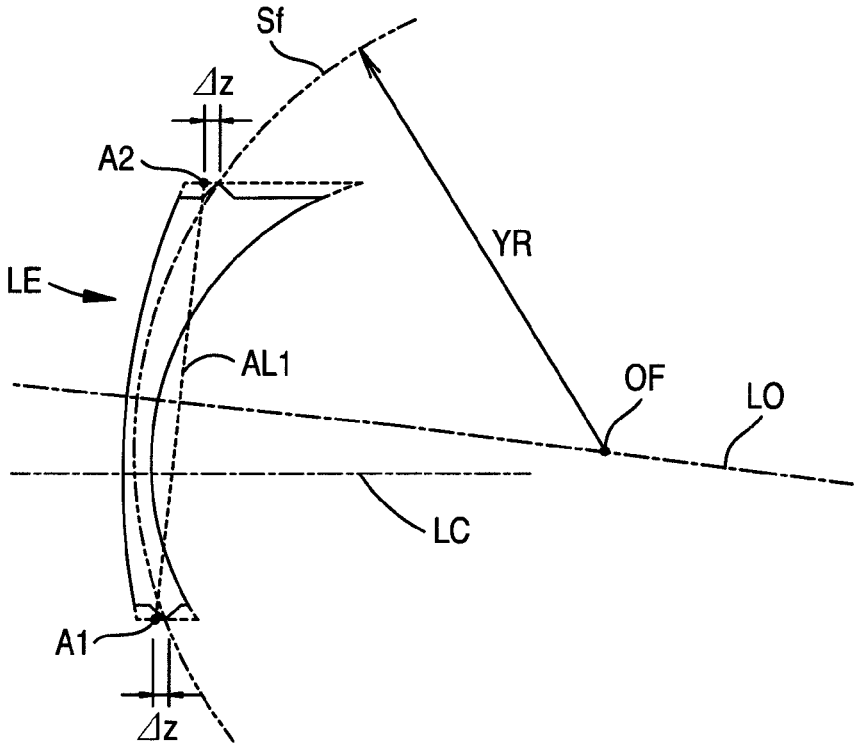
FIG. 7B is an explanatory diagram showing a case where the center of the bevel spherical surface is located on the intersection line so that the bevel spherical surface passes through two points set in a vertical direction, which is a cross sectional diagram showing the lens in a direction of a line AL1.

FIGS. 7A and 7B are explanatory diagrams showing a case where the center OF of the bevel spherical surface Sf is located on the intersection line LO so that the bevel spherical surface Sf passes through the points. A3 and A4 of the line AL2. FIG. 7A is a cross sectional diagram showing the lens LE in a direction of the line AL2, and FIG. 7B is a cross sectional diagram showing the lens LE in a direction of the line AL1. In FIGS. 7A and 7B, the line LC indicates a direction of the lens chuck shafts 102R and 102L, and this example indicates that the chucking operation is carried out at the optical center of the lens.

In FIG. 7A, there is provided the bevel reliably passing through the points A3 and A4 set in a vertical direction. Meanwhile, as shown in FIG. 7B, the bevel position is deviated by the same amount Δz with respect to the points A3 and A4 set in a horizontal direction. Likewise, when the center of the bevel spherical surface Sf having the radius YR of the bevel curve equal to (substantially equal to) the frame curve is located on the intersection line LO set at the first time, it is possible to obtain the bevel path passing through the pair of points A1 and A2 set in a horizontal direction or the pair of points A3 and A4 in a vertical direction. Additionally, since the deviation amounts with respect to the other two points are made to be minimum and substantially equal to each other, it is possible to appropriately dispose the bevel having a good appearance.

Further, even when the edge position through which the bevel spherical surface Sf passes is changed, the deviation amounts with respect to the two points A1 and A2 are substantially equal to each other, and the deviation amounts with respect to the two points A3 and A4 are substantially equal to each other.

Since the bevel path Yt calculated as described above is not within the edge thickness in some cases, the control unit 50 determines whether the bevel path Yt is within the edge thickness (Step S8). As a result, in a case where the bevel path Yt is not within the edge thickness, the bevel curve is changed. In order to cope with this situation, there are a method in which the operator manually changes the bevel curve and a method in which the control unit 50 automatically changes the bevel curve to be approximate to the frame curve (Step S9). Whether the bevel curve is manually changed or whether the bevel curve is automatically changed is selected in advance through a predetermined screen of the MENU key.

A case will be described in which the bevel curve is manually changed. In a case where the control unit 50 determines that the bevel path Yt is not within the edge thickness in the bevel curve equal to the frame curve, the determination is informed as an alarm through the simulation screen shown in FIG. 4 (Step S10). For example, on the target lens shape figure FT shown in FIG. 4, a portion 306 in which the bevel path is not within the edge thickness is displayed by means of a flickering thick line. The operator is capable of checking the degree through the figure of the bevel sectional shape 308 by moving the cursor 302 on the portion 306. In this case, the operator changes the value of the edit box 310 of the bevel curve to a value approximate to the frame curve (Step S11).

When the bevel curve value is changed, a new bevel spherical surface Sf having the radius YR of the bevel curve is obtained by the control unit 50 (Step S12). Subsequently, in terms of the same calculation steps described above, the center OF of the bevel spherical surface Sf after changing the bevel curve is located on the intersection line LO. Additionally, the position of the center OF is calculated by the control unit 50 so as to pass through the two predetermined points (the pair of points A1 and A2 or the pair of points A3 and A4). Then, the bevel path Yt passing through the edge in the whole circumference of the lens is obtained on the basis of the target lens shape data and the changed bevel spherical surface Sf.

When the control unit 50 determines whether the changed bevel path Yt is within the edge thickness of the lens LE, and determines that the bevel path Yt is within the edge thickness of the lens LE, the alarm mark of the display 5 disappears. Accordingly, the operator is capable of simply setting the appropriate bevel curve approximate to the frame curve in a case where the bevel curve is not equal to the frame curve. That is, even in a case where the bevel curve is changed, it is possible to obtain the bevel path which passes through the desired two setting points (the points A1 and A2 or the points A3 and A4) and of which the deviation amounts with respect to the other two points are minimum or equal to each other. Since the intersection line LO is determined at the first time so as to allow the center OF of the bevel spherical surface Sf to be located thereon, it is possible to appropriately dispose the bevel having a good appearance in a simple manner without correcting the tilt direction and the tilt angle of the bevel again like the related art.

A case will be described in which the bevel curve approximate to the frame curve is automatically changed by the control unit 50. In a case where the bevel path having the bevel curve equal to the input frame curve cannot be disposed within the edge thickness, the control unit 50 sequentially changes the bevel curve value through a predetermined step or obtains a changed bevel curve value in accordance with an amount in which the bevel path having the original bevel curve is not within the edge thickness. Then, the bevel path within the edge thickness is obtained on the basis of the target lens shape data and the changed bevel spherical surface Sf, and the bevel path Yt (corrected bevel path) is determined on the basis of the bevel spherical surface Sf having the bevel curve which is the most approximate to the frame curve (Step S13). Even in a case where the changed bevel curve is automatically determined, since the axis (intersection line LO) of the bevel spherical surface Sf having the radius of the bevel curve is set at the first time, it is possible to appropriately set the bevel curve approximate to the frame curve without complicatedly calculating a combination of the tilt amount and the tilt direction of the bevel curve (that is, while reducing a calculation process time) whenever the bevel curve is changed.

It is possible to check the result of the bevel path Yt calculated by the control unit 50 throughout the whole circumference of the lens by means of the sectional shape 308 displayed on the simulation screen. When a processing start switch of the switch unit 7 is pressed after the bevel path is determined, a roughing and a finishing are performed on the circumference of the lens. The control unit 50 controls an operation of the carriage unit 100 in accordance with a processing sequence, controls the X-axis-direction movement of the lens chuck shafts 102R and 102L so that the chucked lens LE moves close to the roughing grindstone 166, and then controls the Y-axis-direction movement thereof on the basis of the roughing processing information (which is obtained from the target lens shape data). Accordingly, the roughing is performed on the lens LE. Subsequently, the lens LE is moved away from the roughing grindstone 166, is located on a bevel groove included in the finishing grindstone 164, and then the lens chuck shafts 102R and 102L are moved in X-axis and Y-axis directions on the basis of the bevel path data, thereby performing a beveling on the circumference of the lens. At this time, since the bevel curve approximate to the frame curve is appropriately formed as described above, the bevel having a good appearance is formed on the peripheral edge of the lens.

What is claimed is:

1. An eyeglass lens processing apparatus for processing a bevel in a peripheral edge of an eyeglass lens, the apparatus comprising:

a data input unit (2) which obtains a shape data of a rim of an eyeglass frame;

an edge position detecting unit (200F, 200R) which obtains edge positions of front and rear surfaces of the lens on the basis of target lens shape data obtained from the rim shape data;

a bevel curve setting unit (50, 5) which sets a bevel curve formed on the lens edge and includes an input unit (300) used to select the bevel curve substantially equal to a frame curve based on at least the rim shape data;

a reference point setting unit (50, 5) which sets first, second third and fourth points which are located on the lens edge and are used as a reference to obtain a bevel path, so that a line located on the target lens shape and passing through the first and second points intersects a line located on the target lens shape and passing through the third and fourth points; and a bevel path calculating unit (50) which:

a) obtains a first plane including a bisection point of a first line connecting the first and second points and perpendicular to the first line;

b) obtains a second plane including a bisection point of a second line connecting the third and fourth points and perpendicular to the second line;

c) obtains an intersection line LO at which the first and second planes intersect each other;

d) obtains a bevel spherical surface Sf so that a center of the bevel spherical surface Sf having a radius of the bevel curve set by the bevel curve setting unit is located on the intersection line LO and the bevel spherical surface Sf passes through a desired edge position; and e) obtains the bevel path on the basis of the target lens shape data and the obtained bevel spherical surface Sf.

2. The eyeglass lens processing apparatus according to claim 1, wherein the reference point setting unit sets the points by a predetermined method on the basis of the target lens shape data and a detection result of the edge position detecting unit.

3. The eyeglass lens processing apparatus according to claim 2, wherein the reference point setting unit includes a display (5) which displays the target lens shape and designates the positions of the points in the target lens shape on the display in advance.

4. The eyeglass lens processing apparatus according to claim 2, wherein the reference point setting unit sets so that the line located on the target lens shape and passing through the first and second points is substantially perpendicular to the line located on the target lens shape and passing through the third and fourth points.

5. The eyeglass lens processing apparatus according to claim 4, wherein the reference point setting unit sets the points so that the line located on the target lens shape and passing through the first and second points and the line located on the target lens shape and passing through the third and fourth points pass through a geometric center of the target lens shape.

6. The eyeglass lens processing apparatus according to claim 2, wherein the reference point setting unit sets the positions of the points located on the lens edge to any one of a position which is offset from the front surface of the lens by a predetermined distance, a position at which an edge thickness of the lens is divided by a predetermined ratio, and a position which is further offset by the predetermined distance from the position obtained by dividing the edge thickness by the predetermined ratio.

7. The eyeglass lens processing apparatus according to claim 1, wherein the reference point setting unit includes a display (5) which displays a assist screen in which a lens shape is displayed on the basis of the target lens shape data and a detection result of the edge position detecting units and which allows an operator to set the points.

8. The eyeglass lens processing apparatus according to claim 1, wherein the bevel path calculating unit includes a selection unit used to select the bevel spherical surface Sf passing through the first and second points or the bevel spherical surface Sf passing through the third and fourth points upon obtaining the bevel spherical surface Sf.

9. The eyeglass lens processing apparatus according to claim 1, wherein the bevel path calculating unit selects the bevel spherical surface Sf passing through the first and second points or the bevel spherical surface Sf passing through the third and fourth points on the basis of a detection result of the edge position detecting units upon obtaining the bevel spherical surface Sf.

10. The eyeglass lens processing apparatus according to claim 1, wherein when the obtained bevel path is not within an edge thickness of the lens, the bevel path calculating unit changes the bevel curve to be approximate to the frame curve, and obtains a corrected bevel path in which a center of the bevel spherical surface having a radius of the changed bevel curve is located on the intersection line LO and which is within the edge thickness on the basis of the target lens shape data and the bevel spherical surface.

* * * * *